United States Patent [19]

Villers, Sr.

[11] 4,427,060

[45] Jan. 24, 1984

[54] GAS WELL BALL RETRIEVER

[76] Inventor: Joseph G. Villers, Sr., 855 Treat Blvd., Tallmadge, Ohio 44278

[21] Appl. No.: 297,740

[22] Filed: Aug. 31, 1981

[51] Int. Cl.[3] ..... E21B 33/068

[52] U.S. Cl. ..... 166/85; 166/301; 166/386; 408/67; 408/82

[58] Field of Search ..... 165/85, 95, 77, 87, 165/97, 277, 332, 301, 386; 175/318; 408/67, 82, 79, 81, 87, 92

[56] References Cited

U.S. PATENT DOCUMENTS

| | | | |
|---|---|---|---|
| 1,872,139 | 8/1932 | Gray et al. | 166/95 |
| 2,213,309 | 9/1940 | Fortune | 166/97 |
| 4,033,414 | 7/1977 | Stroble | 166/301 |
| 4,342,363 | 8/1982 | Reed | 166/95 |

*Primary Examiner*—William F. Pate, III
*Assistant Examiner*—Hoang C. Dang
*Attorney, Agent, or Firm*—John J. Murphey

[57] ABSTRACT

A device for safely ventilating high pressure gas from a gas well that is trapped therein by a pressure seal ball jammed in the well casing head and for retrieving the ball after ventilation is complete comprising a hollow tube adapted for tight attachment into the casing head valve, a shaft suspended therein capable of reciprocal and rotary motion, and means attached to the shaft to pass through the casing head valve and drill into and capture the seal ball and ventilating passages in the tube to allow the ventilating gas to pass off harmlessly.

10 Claims, 3 Drawing Figures

GAS WELL BALL RETRIEVER

BACKGROUND OF THE INVENTION

1. Field of the Invention

This invention pertains to wells and more particular to gas wells. This invention is particularly directed toward a device for retrieving a pressure seal ball that has blown up or risen from the well to the casing head and jammed against the exit nipple thus trapping gas therebelow.

2. Description of the Prior Art

Gas wells are bored relatively deep in the ground; on the order of 4,000 to 8,000 feet. After a hole is sunk to gas bearing rock formations, a perforated casing is inserted to aid in permitting gas to exit therefrom without accompanying sand, broken rock or other debris. As the perforated casing is lowered into the hole, a series of horizontal plates are positioned in some of the casing joints, each plate having a round hole, axially or centrally located therein. The plates are stationed so that the smallest diameter plate hole is located at or near the bottom of the well hole and are progressively larger in diameter as they near the surface of the earth. The largest hole is approximately 4 inches in diameter which is the nominal diameter of the casing itself.

It is necessary that the rock formation through which the well passes be fractured to create a labyrinth of fracture lines or cracks from which the trapped natural gas may escape into the well casing. This is accomplished by either detonating explosive charges within the well casing or by filling the casing with hydraulic fluid and exposing the fluid to extreme pressure.

In both instances, it is desirable to stratify the area of extreme pressure to maximize the effectiveness of the fracturing operation. This is accomplished by dropping spherical composition or plastic balls of desired diameter into the well so that they lodge in the holes of the plates and shut off fracturing operations from below; hence the term "pressure seal" balls, as they seal the fracturing operations from lower areas of the well.

After the desired subterranean sections of the well are fractured, the top of the well casing, or wellhead, is closed off and gas flow from the fractured area is permitted into the well casing until the gas pressure has reached a steady state condition, normally within the range of 2,000 to 2,500 lbs. pressure. The wellhead is thereafter quickly opened to vent the trapped gas; the high pressure discharging gas blows debris, and, hopefully, the pressure-seal balls out of the casing.

After the well is "blown," the wellhead or upper part of the well casing is connected to commercial gas transportation lines. For cost considerations, the 4-inch casing exiting the ground is reduced to 2 inches nominal diameter by use of a reducing nipple and a 2-inch ball or gate valve is attached thereto to control gas flow to the commercial transportation lines. The reason for this is that a 4-inch ball or gate valve costs upwards of $1,200.00 whereas a 2-inch diameter ball or gate valve costs only $400.00 and is far easier to actuate.

A commonl problem in the industry has been the occlusion or entrapment of a pressure-seal ball below one of the plates during gas well blowing. The ball does not dislodge during blowing and float upwards to the wellhead valve sometime after the well has been put into service on a commercial gas line. The ball than becomes trapped in the reducing nipple below the 2-inch wellhead valve and gas pressure in the well increases to 2,000 to 2,500 lbs. pressure. Removing the wellhead 2-inch valve will result in a tremendous explosion of high pressure gas, loss of gas, possible fire and possible personal injury from flying debris or the trapped ball. Without removal, the jammed ball effectively shuts off the well below the 2-inch valve.

The use of a 4-inch ball or gate valve below the 2-inch wellhead valve provides an effective means of shutting off the well to allow removal of the nipple and removal of the ball; however, this results in a continuing necessity to keep a 4-inch, $1,200.00, valve on every wellhead in addition to the 2-inch, $400.00, wellhead control valve. To date, no one has been able to effectively devise a method and/or apparatus to remove a stuck pressure-seal ball from the wellhead without the use of the very expensive dual valve system.

OBJECTS OF THIS INVENTION

This invention is a unique device for use on a singular 2-inch wellhead valve for capturing and retrieving a pressure-seal ball jammed in the wellhead reduction nipple. Other objects of this invention include a device that may be attached to a wellhead to not only capture and retrieve a jammed pressure-seal ball but to safely exhaust the trapped gas in the well casing and direct it into the gas transportation line thus saving the cost of otherwise wasted natural gas. A further object of this invention is a device for temporary use on a wellhead to retrieve a jammed seal ball that may thereafter be removed from the wellhead and used on other gas wells having jammed seal balls. A still further object of this invention is a simple and expedient device for eliminating the potential danger of fire and personal injury accompanying the retrieval of a jammed seal ball from a gas well where gas is trapped at high pressure in the casing. These and other objects of the invention will be readily apparent from a close reading of the preferred embodiments of the invention taken in conjunction with the claims that are appended hereto and made more lucid by referring to the drawings attached and made a part hereof.

PREFERRED EMBODIMENT OF THE INVENTION

Figure 1:
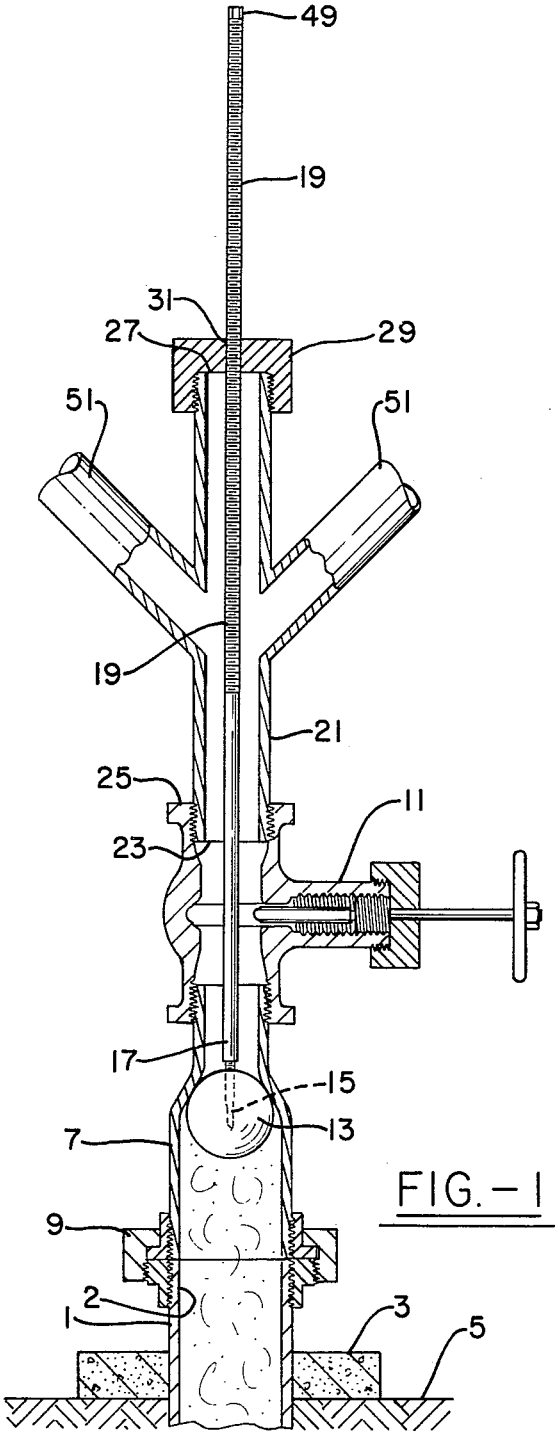
FIG. 1 shows a vertical cross-section of a preferred embodiment of this invention.

FIG. 1 shows a preferred embodiment of this invention and shows a well casing 1 emanating vertically from a wellhead platform 3 of concrete that is set on the earth's surface 5 over a well hole (not shown) as is already known in the art. Well casing 1 is generally a 4-inch nominal diameter pipe terminating at a wellhead 2, above wellhead platform 3 and is joined to a wellhead reducing nipple 7, that reduces the 4-inch nominal diameter casing to 2-inch nominal diameter, through means of a coupling or sleeve 9. The upper or 2-inch diameter portion of wellhead reducing nipple 7 is joined to a conventional 2-inch ball-type or gate-type wellhead control valve 11. In normal operation the top of valve 11 is joined to a commercial distribution line by means of conventional piping (not shown).

FIG. 1 shows a seal ball 13, of diameter larger than 2-inch nominal jammed in wellhead reducing nipple 7; it had blown up or floated to the top of the well after the well has been blown. Trapped below ball 13 is natural gas from the well at pressures ranging from 2,000 to 2,500 psi.

The invention comprises means 15 for drilling a hole in seal ball 13 and then affixing or capturing ball 13 thereto, said means 15 affixed to the lower end 17 of a first shaft 19 that is axially mounted in a vertical tube 21. The lower or bottom end 23 of tube 21 is adapted for a pressure tight fit into the upper or exposed end 25 of wellhead control valve 11. The upper or top end 27 of tube 21 is pressure sealed with a cap 29, welded or threaded thereon, having a central aperture 31 formed therein to receive first shaft 19 therethrough. As shown in FIG. 1, shaft 19 is threaded and mates with threads in aperture 31 to provide reciprocal motion to means 15 as shaft 19 is rotated. Other means of sealing shaft 19 in tube 21 are contemplated in this invention including a hydraulic piston rod arrangement, etc. Other types of attachments for affixing cap 29 to tube end 27 are contemplated such as threaded connections, sweated connections, etc.

Figure 2:
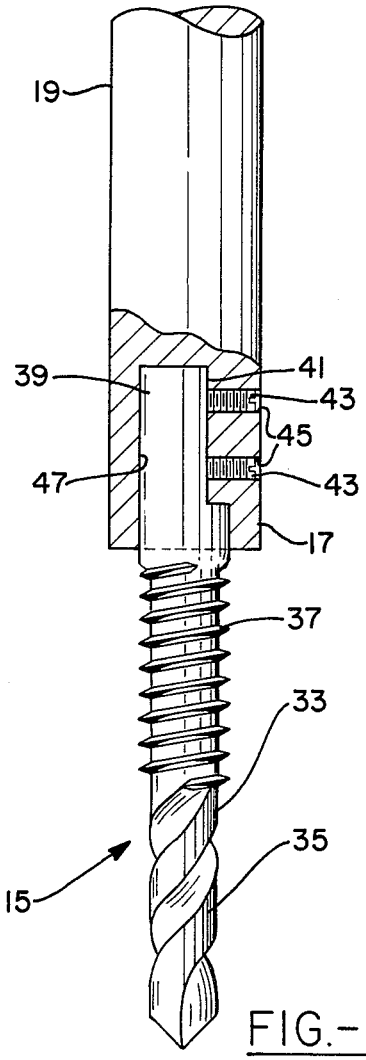
FIG. 2 shows a vertical cross-section of part of the embodiment shown in FIG. 1.

Means 15 is shown in FIG. 2 and axially aligned to said first shaft and connected in axial abutment thereto and comprises a second shaft 33 having a lower drill portion 35, an intermediate threaded portion 37 and an upper coupling portion 39. Lower drill portion 35 may be of a wide variety of drill configurations such as a twist drill or a self-tapping drill-thread combination as is already known in the art; the main function of drill portion 35 is to bore a hole down into the top of seal ball 13 with a minimum of rotational effort and at a diameter that will let threaded portion 37 thread itself onto ball 13. Threaded portion 37 becomes effective after drill portion 35 is into its boring operation. The main function of threaded portion 37 is to self-tap into ball 13 and capture it to make it operate as one solid unit with shaft 19. As threaded portion 37 is twisted into the hole made by drill portion 35, the frictional resistance between the surface of ball 13 and the contacted portion of the inner walls of nipple 7 is overcome, ball 13 begins to twist with the twisting of drill means 15. As shaft 19 is twisted further, seal ball 13 is moved downward and allows entrapped gas to escape upward. To control the flow, ball 13 may be moved upward and/or downward by twisting shaft 19 one way or the other.

Coupling portion 39, at the upper end of means 15, is shown in FIG. 2 to comprise a flat surface 41 formed on the cylindrical surface of shaft 33 that is adapted to mate with a pair of adjustable set screws 43, that enter through threaded holes 45 in lower shaft portion 17, into a receiving chamber 47 formed in the bottom of lower shaft portion 17. Other types of coupling between means 15 and shaft 19 are contemplated in this invention such as welding, sweat fitting, etc.

Figure 3:
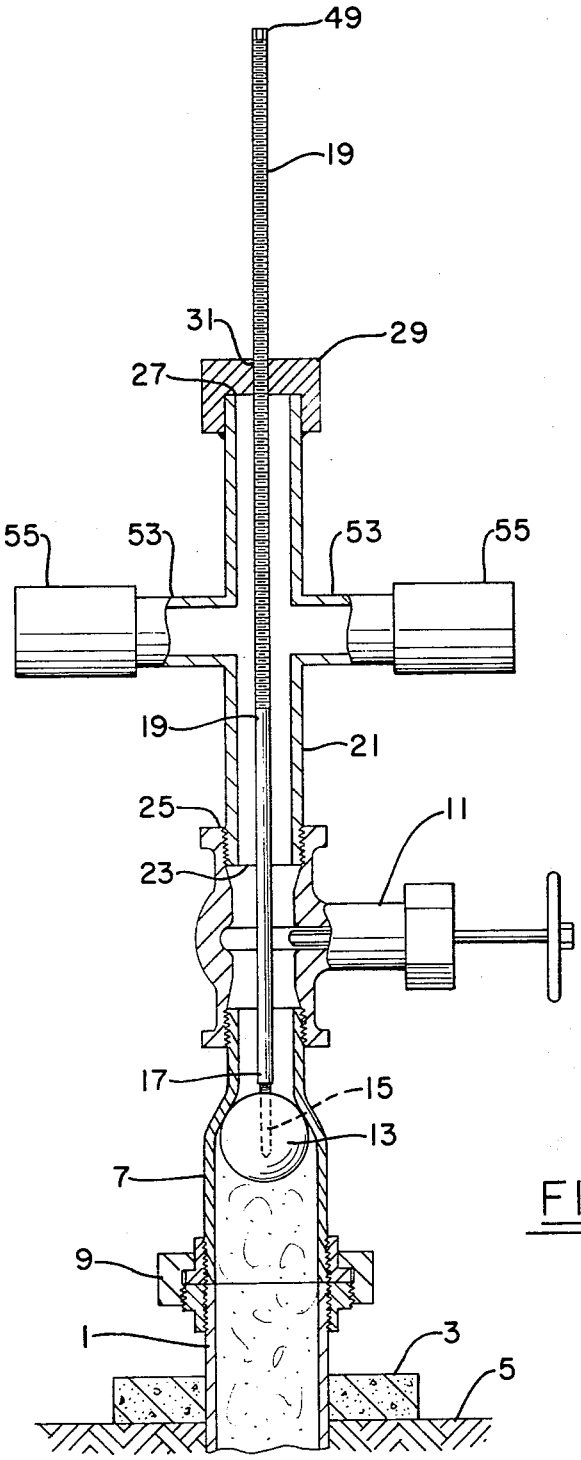
FIG. 3 shows a vertical cross-section of another embodiment of this invention.

The upper end of shaft 19 is formed into a rotational drive coupler 49. As shown in FIGS. 1 and 3, coupler 49 is formed into a series of six contiguous vertical surfaces for use with a common wrench or socket wrench and ratchet to turn shaft 19. Other coupler mechanisms may be used herein within the scope of the invention such as parallel flat surfaces for use with a wrench, etc.

The invention operates as follows: When seal ball 13 becomes stuck in nipple 7 all gas from the well is shut off and opening wellhead control valve 11 further doesn't help. The connecting lines from valve 11 to commercial gas transmission lines are disconnected. This inventive device is then attached to the wellhead control valve at exposed end 25, valve 11 is opened and shaft 19 is rotated to lower drill means 15 through valve 11 so that drill portion 35 engages ball 13. Further rotation of shaft 19 via coupler 49 causes drill means 15 to drill into the ball and thread into a tight relationship with shaft 19. Still further rotation will lower seal ball 13 out of jammed contact in nipple 7 and allow high pressure gas, trapped in the well, to escape up around ball 13 and into tube 21. FIG. 1 shows a pair of vent pipes 51 in tube 21 that are pointed skyward during use to allow the escaping gas to vent above the wellhead out of contact with humans. It is best to place more than one vent in tube 21 and space them equidistant about the circumference of tube 21 to eliminate any torque stress on tube end 23 from the escaping gas.

FIG. 3 shows another embodiment of the invention where tube 21 contains a pair of vent pipes 53 that extend at right angles to tube 21 to couplings 55 that, in turn, attach to the commercial transmission line (not shown). This configuration allows the operator to vent the high pressure, escaping gas directly into the commercial system to prevent loss of gas, save money and reduce the possibility of fire.

After the gas is vented and the pressure in the well reduced to workable levels, the inventive device, valve 11 and nipple 7 are all unscrewed from casing 1 in one unit, seal ball 13 rotated or twisted free of drill means 15 and nipple 7 and wellhead valve 11 screwed back onto well casing 1 and the well put back in service. The device is now ready to be used on another well.

What is claimed is:

1. A device for capturing a seal ball that has jammed in a wellhead of a gas well below a wellhead control valve and for safely venting gas trapped below comprising:
   (a) a hollow tube having one end adapted for attachment to an exposed end of the wellhead control valve and the other end containing seal means to prevent escape of gas therefrom;
   (b) a first shaft axially suspended in said tube, having one end thereof terminating outside said sealed end of said tube, said shaft adapted for rotary and reciprocal motion along the axis of said tube;
   (c) means attached to said first shaft for passing through the open wellhead control valve and drilling into the jammed ball and temporarily capturing the ball to said shaft when said shaft is rotated and advanced toward the ball; and,
   (d) a vent in said tube to permit the escaping gas to pass out of the well when the captured ball is lowered in the casing head.

2. The device of claim 1 wherein said first shaft is threaded and said sealed means comprises a seal cap having a threaded aperture formed therein to mate with threads on said shaft and provide reciprocal motion to said shaft upon rotation thereof.

3. The device of claim 1 wherein said vent comprises at least two vent pipes, equidistantly spaced about the circumference of said tube, angled skyward when said device is attached to the wellhead control valve in a vertical fashion, to vent the escaping gas.

4. The device of claim 1 wherein said vent comprises at least two vent pipes, equidistantly spaced about the circumference of said tube, adapted for connection to a commercial gas transmission line to vent the escaping gas into the transmission line and save the gas as well as reduce the risk of fire and explosion.

5. The device of claim 1 wherein said one end of said first shaft, terminating outside said sealed end of said tube, is formed into a drive coupler that includes a series of parallel, contiguous flats formed in said end for attachment to a common socket wrench ratchet to permit the ratchet to provide rotary motion to said shaft.

6. The device of claim 1 wherein said means attached to said first shaft comprises a second shaft, axially aligned thereto, having an upper coupling portion, for attachment to said first shaft, an intermediate threaded portion to self-tap into the seal ball, and a lower drill portion to bore a hole into the ball to allow said threaded portion to self-tap into the ball when said first and second shafts are rotated and advanced through the wellhead control valve into contact with the ball.

7. The device of claim 3 wherein said drill portion of said means comprises a twist drill.

8. The device of claim 3 wherein said means comprises a self-tapping drill-thread combination to both bore into the seal ball and threadably connect the ball to said first and second shaft.

9. The device of claim 6 wherein said coupling portion of said means comprises a cylindrical chamber formed in said first shaft, adapted to receive therein said second shaft, at least one screw threadably received through an aperture in the wall of said first shaft into said chamber to abut a flat surface formed in the surface of said second shaft to fasten said first and second shafts together in axial alignment.

10. A device for capturing a seal ball that has jammed in a wellhead of a gas well below a wellhead control valve and for safely venting gas trapped below comprising:

(a) a hollow tube open at one end for pressure tight attachment to the wellhead control valve and sealed at the other end thereof to prevent escape of gas therefrom;

(b) a first threaded shaft axially suspended in said tube having one end thereof exiting said sealed end of said tube, for connection to a rotary drive means, and adapted for rotary and reciprocal motion along the axis of said tube;

(c) means attached to said first shaft comprising:

(i) a second shaft axially aligned and abutted to said first shaft and attached thereto comprising:

(1) a lower drill portion to bore a hole into the ball when said first and second shafts are rotated and advanced through the wellhead control valve into contact with the ball;

(2) an intermediate threaded portion to self-tap into the hole in the seal ball, formed by the drill portion, and capture and fix the seal ball to said first and second shafts; and, (3) an upper coupling portion to connect said second shaft in axial abutment to said first shaft; and, (d) a vent in said tube to permit the escaping gas to pass out of the wellhead when the captured ball is lowered in the wellhead by further rotation of said first and second shafts comprising at least two vent pipes, equidistantly spaced about the circumference of said tube, adapted for connection to a commercial gas transmission line to save the escaping gas and reduce the risk of fire and explosion.

* * * * *